US005870061A

United States Patent [19]

Casciola et al.

[11] Patent Number: 5,870,061

[45] **Date of Patent: *Feb. 9, 1999**

[54] COAXIAL SLOT FEED SYSTEM

[75] Inventors: Dean Casciola, Standish; Mike Figoli, Durham, both of Me.

[73] Assignee: Howell Laboratories, Inc., Bridgton, Me.

[ * ] Notice: This patent issued on a continued prosecution application filed under 37 CFR 1.53(d), and is subject to the twenty year patent term provisions of 35 U.S.C. 154(a)(2).

[21] Appl. No.: 655,746

[22] Filed: May 30, 1996

[51] Int. Cl.[6] ..... H01Q 13/10

[52] U.S. Cl. ..... 343/771; 343/770

[58] Field of Search ..... 343/770, 771, 343/772, 768, 786; 333/21 R, 125, 248

[56] References Cited

U.S. PATENT DOCUMENTS

| | | | |
|---|---|---|---|
| 2,648,769 | 6/1953 | Masters | 343/770 |
| 2,660,674 | 10/1953 | Brown | 343/770 |
| 4,150,383 | 4/1979 | Andersson et al. | 343/771 |
| 4,409,595 | 10/1983 | Park | 343/771 |
| 4,613,869 | 9/1986 | Ajioka | 343/768 |
| 4,872,020 | 10/1989 | Ajioka | 343/771 |
| 5,170,174 | 12/1992 | Caer et al. | 343/771 |
| 5,220,337 | 6/1993 | Ajioka | 343/770 |
| 5,272,487 | 12/1993 | Pantsios | 343/771 |
| 5,406,292 | 4/1995 | Schnetzer et al. | 343/700 MS |
| 5,546,096 | 8/1996 | Wada | 343/771 |
| 5,630,337 | 2/1997 | Cassel | 343/770 |

*Primary Examiner*—Don Wong
*Assistant Examiner*—Tan Ho
*Attorney, Agent, or Firm*—Samuels, Gauthier & Stevens

[57] ABSTRACT

A slot antenna has a generally cylindrical waveguide and a feed end. A plurality of slots are formed in the waveguide. A plurality of feed strips are secured to the feed end and are secured to the waveguide in spaced apart relationship from the outer surface of the waveguide. Exciters are in communication with the feed strips and extend over the slots.

2 Claims, 2 Drawing Sheets

COAXIAL SLOT FEED SYSTEM

BACKGROUND AND BRIEF SUMMARY OF THE INVENTION

Slot antennas are well known in the art.

One problem with existing slot antennas is the coupling between adjacent slots which interferes with the radiation patterns for which the antenna is designed.

The prior art solutions to overcoming this problem of coupling between adjacent slots result in a longer antenna than necessary (forming offset slots on a vertical axis) or making a wider antenna. The latter design is harder to seal for pressurization because of wings or protuberances from the antenna.

It is believed that all existing co-ax slot antennas use an internal feed system. The use of the internal feed lines prohibits use of internal feeder lines.

Broadly in the antenna of the invention, an external microstrip feed system allows adjacent slots to be closer to each other without coupling. This improves the radiation pattern. This external feed system also frees up the internal area of the cylindrical waveguide to allow cable to run inside allowing multi-bay antennas under one radome which simplifies assembly and mounting.

The invention in a preferred embodiment is a slot antenna having a generally cylindrical waveguide and a feed end. A plurality of slots are formed in the waveguide. A plurality of feed strips are secured to the feed end and are secured to the waveguide in spaced apart relationship from the outer surface of the waveguide. Exciters are in communication with the feed strips and extend over the slots. The slots and exciters are dimensioned and arrayed to produce a designed radiation pattern.

DESCRIPTION OF THE PREFERRED EMBODIMENT(S)

Figure 1:
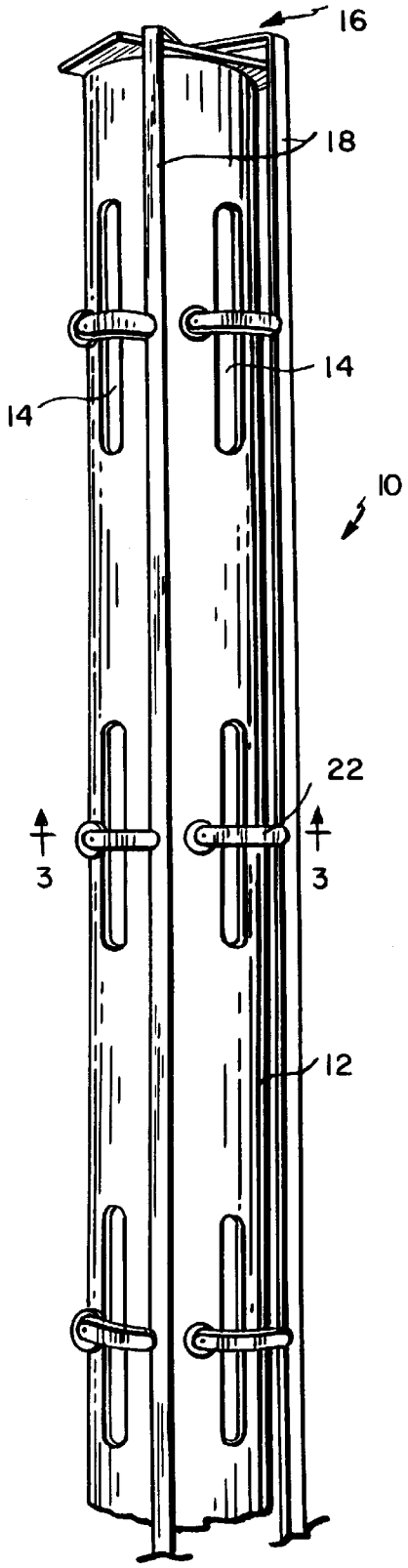
FIG. 1 is an illustration of a slot antenna embodying the invention.
Figure 2:
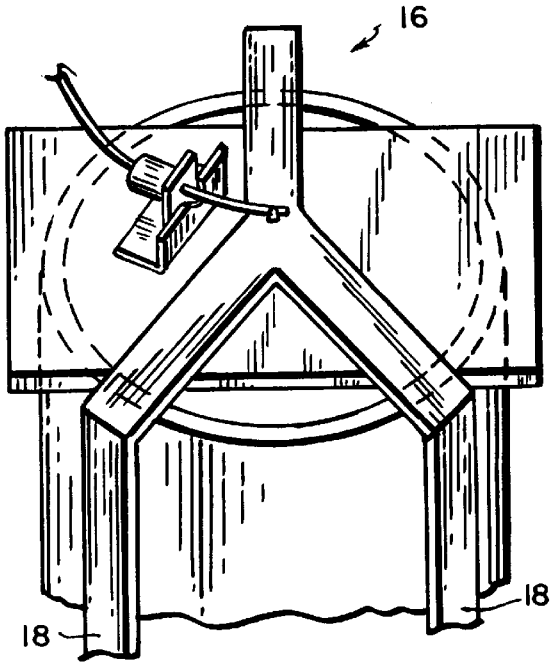
FIG. 2 is an illustration of a feed line assembly for the microstrips of the invention.
Figure 3:
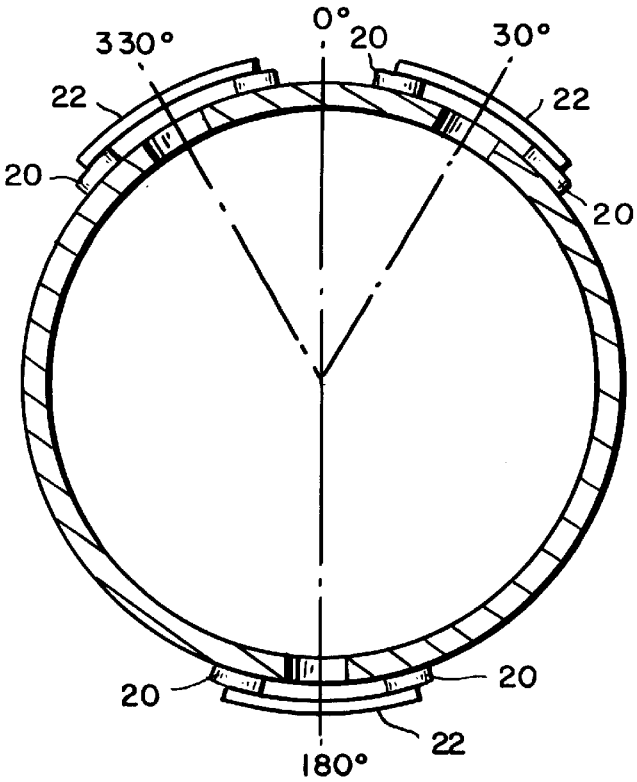
FIG. 3 is a sectional view of an exciter attached to a microstrip and a slot array.

Referring to FIG. 1 a slot antenna is shown generally at 10 and comprises a cylindrical ground plane 12 characterized by slots 14 formed therein. At one end of the antenna is a feed assembly 16, shown in greater detail in FIG. 2. Microstrips 18 are secured to the waveguide 12 by electrical insulators 20 as shown in FIG. 3. The micro strips 18 generally run parallel to the longitudinal axis of the waveguide. Exciters 22 are secured to the microstrips 18 and extend over the slots 14.

Figure 4:
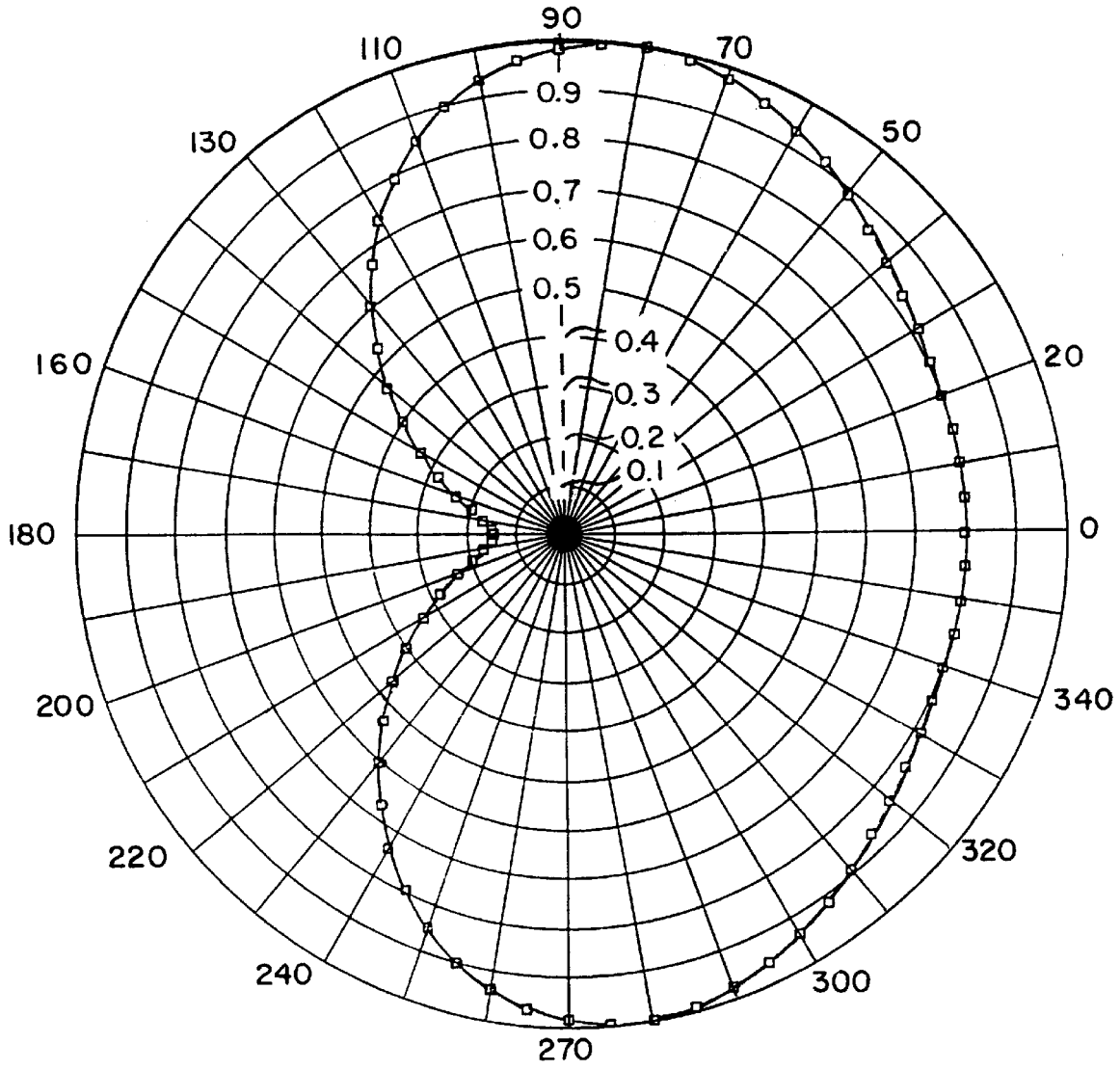
FIG. 4 is a radiation pattern produced by an antenna of the invention.

A slot antenna of the invention having the following characteristics 629 MHz, 6.125 inch diameter tube and 4 slots each at 30°, 180° and 330°, as shown in FIG. 3, produces a radiation pattern such as shown in FIG. 4. For a prior art slot antenna to achieve the same radiation pattern, protuberances to carry the feed lines, would extend from the outer surface of the ground plane. A radome to enclose such a prior art antenna would be larger than the radome to enclose the antenna of the invention. This would also result in more difficulty in creating a pressure seal in the prior art system when compared with the system of the invention.

Although described with reference to a specific embodiment of the invention, the waveguide diameter, number of slots and location of the strips can vary depending upon the pattern desired.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A slot antenna comprising:

a generally cylindrical waveguide having a longitudinal axis, and a feed end;

a plurality of slots formed in the waveguide, the slots dimensioned and arrayed to produce a designed radiation pattern;

a plurality of microstrips secured to the feed end and secured to and spaced apart from the outer surface of the waveguide, the microstrips lying in parallel relationship with reference to the longitudinal axis of the waveguide;

exciters in communication with the microstrips and extending over the slots; and means to feed power through the microstrips and to the exciters to produce the designed pattern, said means to feed being secured to the exterior of the antenna.

2. The antenna of claim 1 wherein the microstrips and exciters are electrically isolated from the waveguide.

* * * * *